US011319706B1

(12) United States Patent
Khedmatgozar Dolati et al.

(10) Patent No.: US 11,319,706 B1
(45) Date of Patent: May 3, 2022

(54) FRP SPLICE SYSTEM FOR JOINING STRUCTURAL ELEMENTS

(71) Applicants: Seyed Saman Khedmatgozar Dolati, Miami, FL (US); Armin Mehrabi, Miami, FL (US)

(72) Inventors: Seyed Saman Khedmatgozar Dolati, Miami, FL (US); Armin Mehrabi, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 17/306,201

(22) Filed: May 3, 2021

(51) Int. Cl.

| | |
|---|---|
| ***E04C 3/22*** | (2006.01) |
| ***E04C 5/20*** | (2006.01) |
| ***E04C 5/16*** | (2006.01) |
| ***E04C 3/29*** | (2006.01) |

(52) U.S. Cl.
CPC ..... *E04C 3/22* (2013.01); *E04C 3/29* (2013.01); *E04C 5/165* (2013.01); *E04C 5/20* (2013.01)

(58) Field of Classification Search
CPC ... E04C 3/22; E04C 3/30; E04C 5/165; E04C 3/29; E04C 5/20; E02D 5/30; E02D 5/52; E02D 5/523; E02D 5/526; E02D 5/64; E04G 2023/0251; Y10T 403/5733
See application file for complete search history.

(56) References Cited

U.S. PATENT DOCUMENTS

| | | | | | |
|---|---|---|---|---|---|
| 1,079,375 | A * | 11/1913 | Strange | E02D 5/523 | 405/252 |
| 2,065,507 | A * | 12/1936 | Alexander | E02D 5/523 | 405/252 |
| 2,698,519 | A * | 1/1955 | Lloyd | E02D 5/523 | 405/252 |
| 3,720,068 | A * | 3/1973 | De Rosa | E02D 5/64 | 405/195.1 |
| 6,123,485 | A * | 9/2000 | Mirmiran | E02D 31/02 | 405/232 |
| 7,429,149 | B2 * | 9/2008 | Price | E02D 37/00 | 405/252 |
| 2004/0086330 | A1 * | 5/2004 | Gregel | E04G 21/122 | 403/314 |
| 2015/0059926 | A1 * | 3/2015 | Ehsani | B27M 3/002 | 144/330 |
| 2015/0190972 | A1 * | 7/2015 | Ehsani | E04H 12/2292 | 156/71 |
| 2015/0345159 | A1 * | 12/2015 | Yamakawa | E04G 23/0218 | 52/514.5 |
| 2019/0177992 | A1 * | 6/2019 | Saadatmanesh | E04C 3/34 | |

FOREIGN PATENT DOCUMENTS

| | | | | |
|---|---|---|---|---|
| EP | 0337543 | A2 * | 10/1989 | E02D 5/523 |

* cited by examiner

*Primary Examiner* — Christine T Cajilig
(74) *Attorney, Agent, or Firm* — Saliwanchik, Lloyd & Eisenschenk

(57) ABSTRACT

Fiber reinforced plastic (FRP) sheet or jacket systems and methods are provided as an alternative splicing method to connect driven pile segments or other structural members. These systems are applicable to both unforeseen and pre-planned splicing situations and can be used in the unforeseen condition when other splice systems may fail to provide the required capacity.

20 Claims, 2 Drawing Sheets

FRP SPLICE SYSTEM FOR JOINING STRUCTURAL ELEMENTS

GOVERNMENT SUPPORT

This invention was made with government support under 69A3551747121 awarded by U.S. Department of Transportation (USDOT). The government has certain rights in the invention.

BACKGROUND

Pile splices can be compared according to many factors, including but not limited to their ability to develop the required capacity (e.g., tension, compression, and flexure), potential modes of failure (e.g., ductile or brittle), splice durability (e.g., corrosion resistance), labor requirements of splice implementation, and the time and equipment needed for installation. There are many types of welded splices, including NCS Splice, Tokyu Splice, Raymond Cylinder, and Bolognesi-Moretto Splice. These splice systems may have concerns for marine environments or any settings with potential for corrosion, as their steel plates can be corroded and cause premature failure of splice system. Bolognesi-Moretto Splices have been shown to be weak in tension (can develop only 50% of pile strength). Also, the application of Brunspile Connector Ring splices has been limited due to their weak performance in tension and flexure.

The disadvantages of epoxy dowel splices may include a significant preparation needed before installation including dowel embedment, casting or drilling of long holes, and strengthening in the splice zone. Also, a crane may be required for a long period of time for installation, corrosion can be a major issue in marine environments, and this splice system may be unlikely to develop the full capacity of pile strength in flexure, especially in application or the splice to an unforeseen and therefore not pre-planned situation. Mechanical splices including but not limited to the Herkules Splice, Marier Splice, Nilsson Splice, and Wedge splices may require time consuming, complex, and expensive fabrication at a prestressing plant.

Additionally, for unforeseen splices, to provide required strength set forward by design specifications, current pile splice systems may require drilling long holes (for inserting the dowels) or special detailing which is not feasible in an unplanned splice situation. Drilling holes with the required length may not be practical on site with current devices, which may limit capacity of existing splice systems.

BRIEF SUMMARY

Embodiments of the subject invention provide novel and advantageous fiber reinforced polymer (FRP) splice systems for joining structural elements. In an embodiment, an FRP splice system can comprise: a first structural element having a first end portion adjacent a first end face; an FRP member affixed to the first end portion; and a first FRP strip encircling the FRP member and the first end portion. The FRP member can cover the majority of at least one side of the first end portion; the FRP member can have a first length measured along the first end portion and a second length extending beyond the first end portion, the first length being equal to (or essentially equal to (i.e., within 2% of) the second length; and the FRP member can be: (a) formed as a unitary (or monolithic) body to form a jacket encircling the first end portion; (b) a first FRP sheet assembled with at least a second FRP sheet to form an FRP sheet splice encircling the first end portion; or (c) a first FRP construct assembled with at least a second FRP construct to form an FRP construct splice encircling the first end portion.

A structural element may comprise concrete, pre-stressed concrete, steel, FRP, composites, or combinations of these, as well as other materials. Structural elements may be prismatic or non-prismatic elongate beams, columns, piers, struts, pedestals, or piles with cross-sections including but not limited to square, rectangular, round, oval, or polygonal shapes.

An end face may be flat and normal to the axial direction of a structural element. Alternatively, an end face may be concave or convex, may have areas or regions which are concave or convex, or may be oriented at an angle to the structural element. An end portion may comprise the sides and interior of a structural element adjacent or near the end face.

In certain embodiments, an FRP sheet may be generally flat and constructed of one layer or multiple layers of FRP material to a desired thickness. An FRP jacket may be generally square, round, polygonal, oval, or any other cross section to match or approximate the exterior shape of the structure to be spliced, and constructed of one layer or multiple layers of FRP material to a desired thickness. An FRP construct may be generally angular, round, "L", "c", "U", or any other cross section to match or approximate in whole, in part, or in one or more sections, the exterior shape of the structure to be spliced, and constructed of one layer or multiple layers of FRP material to a desired thickness. Each layer may have a fiber orientation direction and an FRP sheet may have a fiber orientation defined by a primary direction of fibers used in the manufacturing process. Thickness may be uniform or varied.

When a first object (e.g., a strip, a splice, a jacket, or an assembly) is said to encircle a second object (e.g., a splice, a sheet, a jacket, a construct, a structural element, and end portion, or an end face) it may entirely, fully, partially, or intermittently surround the periphery of that object with a large gap, a gap, a small gap, a minimal gap, or no gap between the first object and the second object. In the case of two or more first objects or an assembly forming the first object (e.g. four flat sheets encircling a square pile to form a sheet splice) there may be a large gap, a gap, a small gap, a minimal gap, or no gap between objects or elements of an assembly. Gaps may be designed to accommodate sealants, adhesives, resin, or other materials, and may be filled or closed by such materials or other materials known in the art to bond with structural elements.

In another embodiment, the system may further comprise a second structural element having a second end portion adjacent a second end face, the second end face being positioned opposing the first end face; a second FRP strip encircling the FRP member and the second end portion; an alignment bar protruded from one of the first end face or the second end face; an alignment receptacle recessed within the other of the first end face or the second end face, the alignment receptacle configured to receive the alignment bar when the first end portion is in a desired state of alignment with respect to the second end portion; and a resin bonding the FRP member to at least one of the first end portion, the second end portion, the first FRP strip, or the second FRP strip.

Certain embodiments may comprise a discrete alignment feature (e.g., alignment bar, and/or alignment receptacle) to align structural elements. Alternatively, certain embodiments may align structural elements without a separate alignment feature or may use the FRP element(s) as alignment features.

In another embodiment, the FRP member may have a fiber orientation along the direction of the first length, and the first FRP strip may have a fiber orientation along a direction encircling the FRP member and the first end portion. An FRP strip may have a fiber orientation perpendicular to a fiber orientation of an FRP sheet or an FRP jacket in a splice. Other fiber orientations can be used in design to satisfy strength requirements. A third FRP strip may encircle the first FRP member, the first end face, and the second end face, the third FRP strip having a fiber orientation along a direction encircling the FRP member, the first end face, and the second end face. The FRP member may be formed of either a single layer or multiple layers, and at least one of the first FRP strip, the second FRP strip, and the third FRP strip may be formed of either a single layer or multiple layers.

In another embodiment, the FRP member may have a set of design parameters comprising a number of layers, a thickness, and a modulus of elasticity; the set of design parameters can be chosen or configured to produce a development of moment from the FRP splice system equal to or greater than the moment of the first structural element.

In another embodiment, the alignment bar may be a generally cylindrical protrusion and the alignment receptacle may be a drilled or cast hole. Alignment features (e.g., the protrusion or the hole may) be formed of materials suitable to the application (e.g., including but not limited to concrete, metals, polymer, FRP) and may be integral to the structural element (e.g., formed and cast with the casting or a pre-stressed concrete pile) or additional (e.g., an FRP end cap with one or more depressions or protrusions bonded to a pile after construction of the pile).

In another embodiment, at least the FRP member and the first FRP strip may be either formed separately and then assembled to the first end portion, or formed together as a unit prior to assembly to the first end portion. The FRP member and the FRP strip may be of the same or different materials and construction.

In an embodiment, one or more FRP strips may be wrapped around a splice forming one or more layers with or without a region of overlap. Alternatively, one or more FRP strips may be pre-formed for later assembly or bonding into the splice.

In another embodiment, the first structural element and/or the second structural element each may be a prismatic prestressed concrete pile (e.g., an 18 inch by 18 inch square prestressed concrete pile.)

In another embodiment, a method for joining structural elements with a fiber reinforced polymer (FRP) splice system may comprise: (a) providing a first structural element having a first end portion adjacent a first end face; (b) affixing an FRP member to the first end portion such that a first length of the FRP member runs along a portion of the first end portion and a second length of the FRP member essentially equal to the first length extends beyond the first end portion, and the FRP member covers the majority of at least one side of the first end portion over the first length; and (c) affixing a first FRP strip encircling the FRP member and the first end portion, thus forming a first pre-spliced structural element.

The method may further comprise: providing a first alignment feature by either (a) creating or placing a recess on the first end face or (b) creating or placing a protrusion on the first end face; providing a second structural element having a second end portion adjacent a second end face; positioning the second end face opposing the first end face; advancing the first end face to a position proximal the second end face to create a desired state of alignment of the first end portion with respect to the second end portion, the desired state of alignment may be such that the FRP member, after being affixed, covers the majority of at least one side of the second end portion over the second length; affixing the FRP member to the second end portion; and affixing a second FRP strip encircling the FRP member and the second end portion.

The method may further comprise: providing a second alignment feature by either (a) creating or placing a recess on the second end face or (b) creating or placing a protrusion on the second end face. The step of advancing the first end face to a position proximal the second end face may comprise engaging the first alignment feature with the second alignment feature to align the first end face with the second end face. The FRP member may have a fiber orientation along the direction of the first length, and the first FRP strip may have a fiber orientation along a direction encircling the FRP member and the first end portion. The method may further comprise affixing a third FRP strip encircling the first FRP member, the first end face, and the second end face; the FRP member may be formed of either a single layer or multiple layers, and the first FRP strip, the second FRP strip, and the third FRP strip may be formed of either a single layer or multiple layers. The step of affixing the FRP member to the first end portion may occur at a manufacturing location remote from a construction site, and the step of affixing the FRP member to the second end portion may occur at the construction site following transportation of the first pre-spliced structural element from the manufacturing location to the construction site. Alternatively, the step of affixing the FRP member to the first end portion, and the step of affixing the FRP member to the second end portion may both occur at the construction site either sequentially or simultaneously. Alternatively, the step of affixing the FRP member to the first end portion, and the step of affixing the FRP member to the second end portion may both occur after one or more of the first structural element and the second structural element has been installed, partially installed, driven, or erected at a construction site. By construction site, is meant to include sites of new construction, repairs, and/or renovations.

In another embodiment, a fiber reinforced polymer (FRP) splice system for joining structural elements may comprise: a first structural element having a first end portion adjacent a first end face; an FRP member affixed to the first end portion a first FRP strip encircling the FRP member and the first end portion; a second structural element having a second end portion adjacent a second end face, the second end face may be positioned opposing the first end face; a second FRP strip encircling the FRP member and the second end portion; an alignment bar protruded from one of the first end face or the second end face; an alignment receptacle recessed within the other of the first end face or the second end face, the alignment receptacle configured to receive the alignment bar when the first end portion is in a desired state of alignment with respect to the second end portion; a resin bonding the FRP member to at least one of the first end portion, the second end portion, the first FRP strip, and the second FRP strip; and a third FRP strip encircling the first FRP member, the first end face, and the second end face. The FRP member may have a first length measured along the first end portion and a second length extending beyond the first end portion, the first length being equal to (or essentially equal to (i.e., within 2% of) the second length; the FRP member may cover the majority of at least one side of the first end portion over the first length; and the FRP member may be: (a) formed as a unitary body to form a jacket encircling the end portion; (b) a first FRP sheet assembled with at least a second FRP sheet to form an FRP sheet splice encircling the end portion; or (c) a first FRP construct assembled with at least a second FRP construct to form an FRP construct splice encircling the end portion.

In some embodiments, the FRP member may have a fiber orientation along the direction of the first length, the first FRP strip having a fiber orientation along a direction encircling the FRP member and the first end portion; the FRP member may be formed of either a single layer or multiple layers; at least one of the first FRP strip, the second FRP strip, and the third FRP strip may be formed of either a single layer or multiple layers; the FRP member may have a set of design parameters comprising a number of layers, a thickness, and a modulus of elasticity; the set of design parameters may be chosen or configured to produce a development of moment from the FRP splice system equal to or greater than the moment of the first structural element; the alignment bar may be a generally cylindrical protrusion; the alignment receptacle may be a drilled or cast hole; the FRP member and the first FRP strip either may be formed separately and then assembled to the first end portion, or may be formed together as a unit prior to assembly to the first end portion; and the first structural element and/or the second structural element each may be a prismatic prestressed concrete pile.

DETAILED DESCRIPTION

Figure 1:
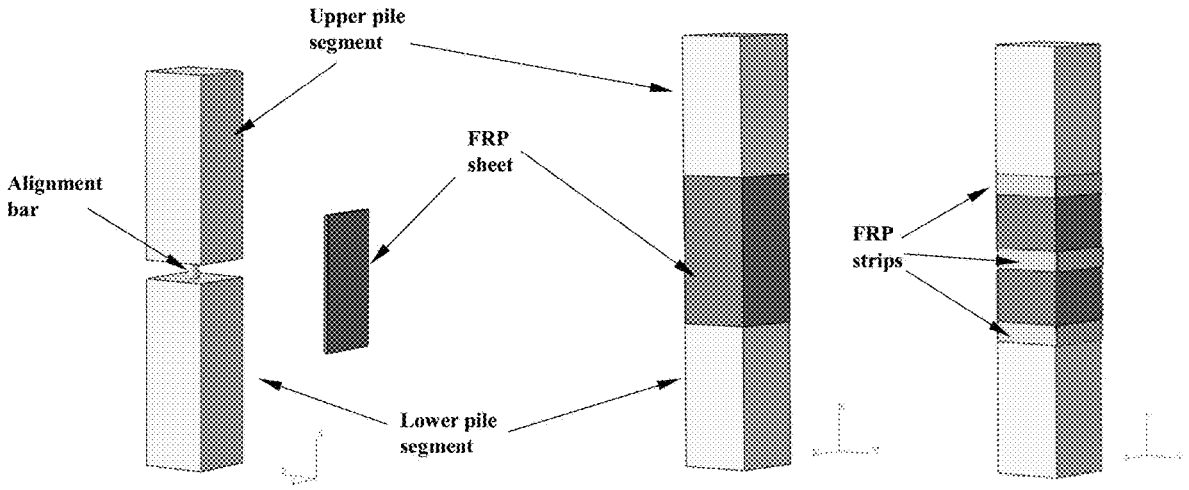
FIG. 1 is a graphical representation of a prestressed pile spliced with a fiber reinforced polymer (FRP) sheet in accordance with an embodiment of the subject invention, shown from a perspective view in three stages of assembly.

Embodiments of the subject invention provide novel and advantageous fiber reinforced polymers (FRP) sheet or jacket systems and methods as an innovative alternative splicing system or method to connect driven pile segments or other construction or structural elements. This system is applicable to both unforeseen and preplanned situations and provides excellent advantage especially for the unforeseen condition when other splice systems may fail to provide the required capacity.

Embodiments of the subject invention offer advantages over existing methods. In certain aspects, embodiments of the subject invention are considerably easier to implement, as embodiments may be useful for both unforeseen and preplanned situations and may need little or minor modification to pile segments. The introduced splice system may not need advanced preparation as much as other techniques and its application involves mainly applying resins and wrapping. Performing this splice system is as easy as wrapping in a paper, compared to related art methods that may require drilling or casting holes, mixing and application of epoxy, careful detailing and QC for alignment of holes and dowels, etc. For instance, one common splice system currently in use (epoxy dowel), may require 8 or 9 drilled or cast long holes, applying epoxy material, and handling the pile segments using a crane which is a time consuming process and carries safety hazard risks.

In other aspects, embodiments of the subject invention require little or no modifications to the pile segments to be spliced. In certain embodiments, the small element protruded from upper pile segment has been designed to ease the installation process and assure alignment. The role of the hole is to provide space for inserting a protruded alignment element. Therefore, there is no need for the hole to be very deep. Providing this small hole operationally is a minor activity and so very time efficient. In certain embodiments, the hole and projected bar can be eliminated altogether provided sufficient attention for alignment during the installation as the FRP sheet or jacket may in some cases provide some or all required alignment for the splice.

Advantageously, a contractor can be trained easily to complete the splice according to certain embodiments. Training challenges attributed to current pile splices include ensuring a proper weld on site (welded splices need skilled and certified labor), mixing and application of epoxy grout requires additional skills and training, and for mechanical splices there is a need for careful and quality fabrication by skilled labors at a prestressing plant. Embodiments of the subject invention have none of the challenges mentioned above and the jobsite laborer can splice pile segments easily with minimal special training. Contractors may need to have trained technicians in the use and application of FRP, but the training for this splice system is not major and may readily be provided, e.g., by the material suppliers.

Due in part to material selection and simplicity of design, embodiments of the subject invention may be inherently durable and corrosion resistant, providing the ability to perform better in marine environment. The rate of corrosion of steel piles immersed in fresh water is estimated to be 0.03 mm per year which increases by up to four times in the splash and marine zone. Certain FRP materials in accordance with the subject invention may not have any iron in it and may be highly or fully corrosion resistant. FRP may commonly consist of glass or carbon fiber and resins, none of which can be corroded.

Embodiments of the subject invention provide splices that are lightweight and environmentally friendly. FRP includes lightweight materials that have low densities compared to other materials used for splices. For example, FRP weighs about ⅕ of steel. Production of FRP has significantly lower carbon footprint than steel. Also, the strengths of carbon fiber reinforced polymers are more than double that of conventional steel, therefore requiring less material.

Embodiments provide for the required strength rapidly to allow driving of the pile to continue. In comparison of the FRP system with epoxy dowels system, the FRP system may reach the required strength faster than epoxy dowel splices.

Embodiments may overcome shortcomings of unforeseen splices that are unable to provide the required splice strength or cannot develop required strength set forwarded by design specification in an unforeseen situation. In some cases, on site devices are not able to drill holes with required length for existing splice systems. As such the required development length cannot be achieved which can cause premature failure of existing splice systems. Also, the lower pile segments cannot accommodate modifications applied in preplanned splices. Embodiments of the subject invention may not need any, or may require only limited, holes to be drilled and modifications to be applied to the lower segment.

The simplicity inherent in embodiments of the subject invention provides for both preplanned and unforeseen situations. In certain embodiments, there is no need to provide any preparation for the pile segments, including any holes or other modifications. Embodiments provide a technique that is simple and may be performed on site without any special detailing.

In some aspects the FRP sheet/jacket of embodiments of the subject invention provides an innovative alternative to the existing methods to connect driven pile segments both in unforeseen and preplanned situations. The system provides excellent advantage especially for the unforeseen condition when other splice systems may fail to provide the required capacity.

Certain embodiments include one or more FRP sheets and one or more alignment elements (e.g. a protrusion from one pile into a recess on the mating pile). Primary alignment may be implemented such that the lower and upper pile segments are in straight line. Secondary alignment may be implemented such that the lower and upper pile segments are in rotational or angular alignment. Alignment devices can be made of bar, rod, and other shapes. One or more layers of FRP sheet may be attached to each side of a pile segment at or near the joint location with the use of resin or other suitable means of attachment. There are many types of resins known in the art and available in the market which can be implemented for the splice system of the subject invention, providing that it reaches the required strength rapidly and prevents any debonding. In many cases the suppliers of FRP specify the type of resin compatible with the product. Additionally, mechanical connectors may be added at or across the FRP to concrete interface to improve bond. One or more alignment bars protruded from a pile segment (e.g., an upper pile segment) may be placed into one or more holes (e.g., a hole at the center) of a mating pile segment (e.g., a bottom pile segment) to facilitate the installation of the pile and assure the alignment between segments. A hole or holes can be cast for the case of preplanned and drilled for the case of unforeseen splices. In some embodiments, an equal amount of FRP may be applied on each face of the pile. The FRP for splicing may also be fabricated in a jacket form with multiple sides (e.g., four sides) pre-connected to form a box. In this case, the jacket may be pre-fitted or pre-attached to a segment (e.g., an upper pile segment) at the precast plant, at the jobsite, or at a remote location. Many factors may inform the design of the FRP sheet/jacket splice system, including but not limited to: the mechanical properties of FRP sheets; the thickness and the number of layers in each side, area, portion, region or segment of the splice; and the required length of FRP sheets/jacket for developing the tension in the FRP sheet (transfer of stresses to concrete and therefore to the strands in the pile) and to prevent debonding of FRP sheets from concrete.

The most common types of FRP materials can be categorized into Carbon FRP (CFRP) and Glass FRP (GFRP). Their properties vary in terms of ultimate tensile strength, ultimate tensile strain, and modulus of elasticity depending on the supplier, material, fiber content. FRP material with higher mechanical properties may be employed, providing that the cost of splice will not be changed dramatically.

In certain embodiments one thicker layer of FRP rather than several thinner layers may be employed to reduce labor costs and improve manufacturing efficiencies. In alternative embodiments, multiple thinner layers may be employed, e.g., to improve mechanical properties of the splice.

Providing a required development length is necessary as otherwise the FRP sheet/Jacket can be debonded from the concrete and cause premature failure of splice system. Debonding refers to loss of cohesion and bond between the FRP sheet and concrete. Depending on the type of material, interface between FRP and concrete can only resist up to a certain level of stress, called bond strength. Higher bond strength requires shorter length to transfer the tension force from FRP to concrete. Therefore, the development length is dependent on the type of material, the bond strength, the modulus of elasticity of FRP, the number and thickness of FRP layer, and the compressive strength of concrete.

In some embodiments, additional restraint against peeling off edges and tapering the sheet ends to reduce resistance against driving may be provided by addition of FRP strips (e.g., in a perpendicular direction.) These strips may also serve as shear reinforcement at splice. The thickness and number of FRP strips as well as the spacing between them may be derived or calculated to optimize factors including but not limited to shear resistance and confinement.

FRP strips can be easily wrapped over the FRP jacket/sheet and assure confinement against peeling off. Pins or resins can be implemented to provide an improved bond between FRP sheet/jacket and FRP strips. The width and thickness of strips may also depend on the level of shear force to be transferred from one pile segment to the other. As one non-limiting example, each strip can be 6-inch wide and 0.2-inch thick, and three strips may be used.

It often happens that shipping and transportation constraints or other reasons limit the length of prestressed-precast concrete piles (PPCP) segments that can be delivered to a bridge or other construction site. In some cases, variable and unforeseen soil conditions may also require longer piles than anticipated. Hence, splicing of pile segments at the site may be required to achieve longer lengths using various types of joints. Connecting pile segments in a preplanned situation gives more choices for splicing types and allows preparing the receiving (lower) segment of piles with additional reinforcement, holes, or other embedment. However, in an unforeseen situation (e.g., because of unpredictable soil conditions) the prescribed length of driven piles often cannot produce the required resistance and a need to splice piles arises. In such cases, the receiving (lower) segment of the pile often has not been prepared or cast with splicing in mind, and therefore requires site preparation such as drilling holes to receive dowels. Because of practical limitations at the site, achieving the required capacity at the splice often is challenging, costly, or simply not possible. ACI 318-14 determines that the pile splice shall be able to develop strength in tension, compression, and bending of the pile it is connecting. For example, the Florida Department of Transportation (FDOT) design specifications prescribes 245 kip-ft moment capacity for 18"×18" square prestressed pile. However, because existing splice methods, e.g., an epoxy dowel splice, may use dowels positioned in the middle part of a cross section, these may produce a small moment arm which cannot develop the required moment strength. In embodiments of the subject invention which are applied externally, the moment strength can be easily matched as shown in Table 1.

An FRP sheet/jacket splicing system and method in accordance with certain embodiments of the subject invention was developed as an innovative alternative to the existing methods to connect driven pile segments both in unforeseen and in preplanned situations. Embodiments of the subject invention provide multiple excellent advantages especially for the unforeseen condition when other splice systems may fail to provide the required capacity. Some embodiments include one or more FRP sheets and an alignment bar. Alternatively, one or more layers of FRP sheet are attached to one or more sides (e.g., sheets may be attached to each side, or to only select sides) of a pile segment at the joint location (e.g., with the use of resin as a bonding agent.) In some embodiments an alignment bar protruded from the upper pile segment may be placed into a hole (e.g., a hole at the center) of the bottom pile segment to facilitate the installation and assure the alignment (e.g., as shown in FIG. 1). An alignment hole or other feature can be, for example, cast for the case of preplanned and drilled for the case of unforeseen splices. An equal amount of FRP may be applied on each face of the pile. Alternatively, variable amount, specification, geometry, design, configuration, or alignment of FRP may be advantageously applied (e.g., by adding more or stronger material or reinforcement in one or more directions of anticipated loading.) The FRP for splicing can also fabricated in a jacket form (e.g., with four sides already connected like a box.) Additionally, the jacket may be pre-fitted and pre-attached to the upper pile segment at the precast plant.

In an embodiment for a specific job or application, based on the size of piles in a specific construction project, the designer may determine the number of splices to be made at the site. Accordingly, the material sheet for the contract may include number of sheets, the length, width, number of layers, and thickness of sheets and the amount of resin required for installation. For each pile splice, four sheets may be required or one jacket needed. Alternatively, two 90-degree corner jackets, or one 180-degree, three sided "U" shaped jacket may be used. The sheets may come already tapered at their ends, or otherwise detailed to support proper installation and alignment. FRP strips will come on a spool with a pre-specified width and thickness. Alternatively, FRP single layer sheets may be delivered to the site for layer-by-layer application. The technicians may inspect the material before installation to be free from possible defects. After driving the lower segment of piles, the driving operation will pause to allow installation of an upper segment and application of FRP sheets/jacket. In case, the designer requires additional anchorage, mechanical connectors/fasteners can be applied to improve the bond.

Turning now to the figures, FIG. 1 is a graphical representation of a prestressed pile spliced with FRP sheet in accordance with an embodiment of the subject invention, shown from a perspective view in three stages of assembly. Though FIG. 1 shows an 18 inch square prestressed pile, this is for exemplary purposes only and should not be construed as limiting. FIG. 1 graphically illustrates a process whereby four FRP sheets are applied across a joint formed by the end faces of two pile segments joined together with an alignment bar. The FRP sheets are oriented in a generally axial direction with respect to the piles. Three FRP strips are added in a circumferential direction, encircling the FRP sheets, the upper pile, the lower pile, the end face of the upper pile, and the end face of the lower pile.

Figure 2:
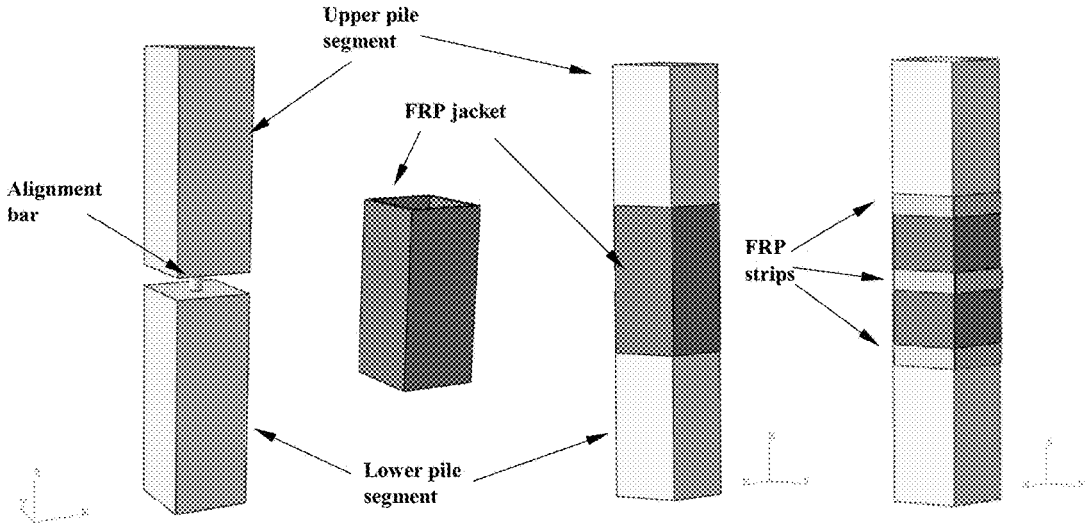
FIG. 2 is a graphical representation of a prestressed pile spliced with an FRP jacket in accordance with an embodiment of the subject invention, shown from a perspective view in three stages of assembly.

FIG. 2 is a graphical representation of a prestressed pile spliced with an FRP jacket in accordance with an embodiment of the subject invention, shown from a perspective view in three stages of assembly. Though FIG. 2 shows an 18 inch square prestressed pile, this is for exemplary purposes only and should not be construed as limiting. The FRP jacket is assembled over the joint formed by the end face of the upper pile mating to the end face of the lower pile segment, aligned by and alignment bar. The FRP jacket is provided as a unitary body with four sides to match the four sides of the upper and lower pile segments. Three FRP strips are added in a circumferential direction, encircling the FRP jacket, the upper pile, the lower pile, the end face of the upper pile, and the end face of the lower pile.

Many factors may be advantageously considered in designing the FRP sheet/jacket splice system, including but not limited to: 1) the mechanical properties of FRP sheets; 2) the thickness and the number of layers in each sheet; and 3) the required length of FRP sheets/jacket for developing the tension in the FRP sheet (e.g., as required for transfer of stresses to concrete and therefore to the strands in the pile) and to prevent debonding of FRP sheets from concrete. Special restraint against peeling off edges and tapering the sheet ends to reduce resistance against driving may be provided by addition of FRP strips (e.g., in a perpendicular direction). These strips may also be advantageously applied to serve as shear reinforcement at the splice. The thickness and number of FRP strips as well as the spacing between them may be calculated or designed for shear resistance and confinement.

Figure 3:
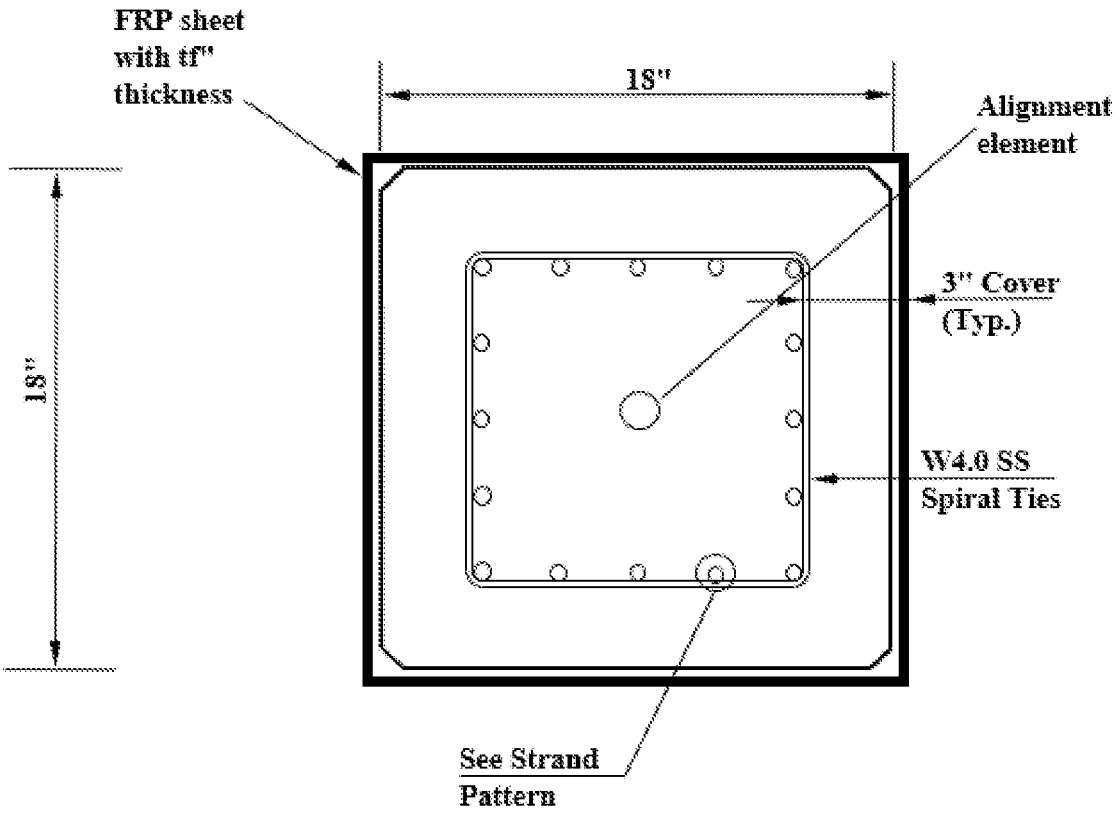
FIG. 3 is a graphical representation of a prestressed pile spliced with an FRP sheet or jacket splice in accordance with an embodiment of the subject invention, shown from the top view and side view.
Figure 3:
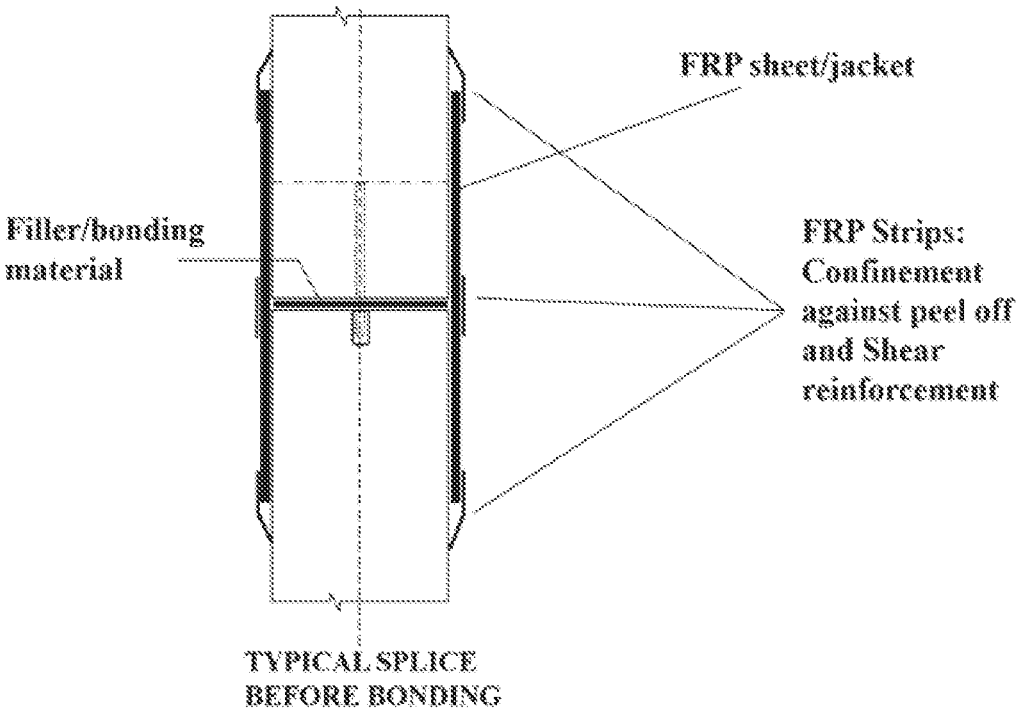

FIG. 3 is a graphical representation of a prestressed pile spliced with FRP sheet in accordance with an embodiment of the subject invention, shown from the top view and side view. Though FIG. 3 shows an 18 inch square prestressed pile, this is for exemplary purposes only and should not be construed as limiting. In the top view, the concrete pile can be seen as an 18 inch (18") by 18" square with chamfered corners, a 3" cover (typ.) of concrete around central W4.0 SS spiral ties with a reinforcing strand pattern, and an alignment element at the center of the pile. The FRP sheet splice material is positioned around the periphery of the 18" by 18" square concrete pile. The side view is labelled, typical splice before bonding, and shows an upper pile above a lower pile with a filler or bonding material (e.g., epoxy) therebetween. Hidden lines show the alignment element protruding from the top pile into a matching drilled hole in the bottom pile, the alignment element spanning across the filler/bonding material from the upper pile to the lower pile. Also in the side view, one FRP sheet is shown on the left side and one on the right side of the splice, respectively, and three FRP strips are shown in cross section wrapping around the top, middle, and bottom of the splice, respectively, to provide confinement against peel off and shear reinforcement. The middle FRP strip is a simple band of rectangular cross section, while the upper and lower FRP strips have a band around the end of the FRP sheet with a ramped chamfer transitioning down to the outside of the pile and filling the space there at each end of the splice. The FRP sheet and strips are not shown across the front of the splice in this side view, for clarity. An FRP jacket splice would have a similar appearance, with the four sheets replaced by a single piece jacket having a cross section matching the outside of the piles (e.g., 18" by 18" square, or any appropriate shape to support the shape of the piles.) Alternatively, embodiments may be formed by 2-sided (e.g., "L" shaped), 3-sided (e.g., "U" or "C" shaped), multi-sided, rectilinear, curved, round, or oval shaped FRP sheets, as appropriate to support the piles or other structural members in the splice.

Embodiments of the subject invention provide novel and advantageous opportunities to improve the construction operation for splicing driven piles. It may also provide for significant improvement for strength and durability of spliced piles, especially for unforeseen splice situations. Durability of pile splices in marine and corrosive environments may also be increased remarkably.

Embodiments of the subject invention are readily applicable to splicing of precast-prestressed concrete piles for bridge and building foundations. While the application of certain embodiments may be advantageously applied to prestressed-precast concrete piles, these same or other embodiments can easily be adapted for splicing other pile types as well as assembling columns, piers, and all structural prismatic elements.

With the importance of the topic for resiliency of bridges, e.g., in the coastal and marine areas, and the level of support and interest from governmental and other agencies, there is a substantial potential for commercialization of embodiments of the subject invention, with a great potential to be used in trial piles in ongoing construction projects as a method of choice.

When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to embodiments of the invention.

Example—Construction and Testing of Prototype Splices

Based on the section analysis in ACI 440-17, FRP splices in accordance with certain embodiments of the subject invention were designed for 18×18" FDOT standard prestressed concrete pile using different thicknesses and number of FRP layers (as shown in Table 1). For this test, only carbon fiber reinforced polymers (CFRP) were used due to their desirable strength and modulus properties.

TABLE 1

Comparison of design moment capacity of FRP splice for different number and thickness of CFRP sheets FRP Sheet

| Row | Type | $n_f$ | $t_f$ – in. | $f_{su}$ – ksi | $\varepsilon_{sfu}$ | $E_f$ – ksi | $\varphi M_n$ – kip-ft | Development of Moment (%) | Development of Tension and Compression (%) | Development length-in. (Order: last sheet to first sheet) |
|---|---|---|---|---|---|---|---|---|---|---|
| 1 | Carbon | 3 | 0.12 | 350 | 0.014 | 24656 | 255 | 104 | More than 100 | 25, 31, 37 |
| 2 | Carbon | 2 | 0.12 | 350 | 0.014 | 24656 | 212 | 87 | | 22, 28 |
| 3 | Carbon | 3 | 0.12 | 280 | 0.015 | 18000 | 222 | 91 | | 22, 28, 34 |
| 4 | Carbon | 7 | 0.12 | 280 | 0.015 | 18000 | 183 | 75 | | 19, 25 |
| 5 | Carbon | 4 | 0.12 | 280 | 0.015 | 18000 | 252 | 103 | | 25, 31, 37, 43 |
| 6 | Carbon | 3 | 0.12 | 330 | 0.016 | 20542 | 235 | 96 | | 23, 29, 35 |
| 7 | Carbon | 4 | 0.12 | 330 | 0.016 | 20542 | 266 | 109 | | 26, 32, 38, 44 |
| 8 | Carbon | 3 | 0.12 | 410 | 0.015 | 27180 | 265 | 108 | | 26, 32, 38 |

Table 1 shows the calculation for a complete splice made from CFRP sheets. The parameters nf, tf, fsu, esfu, and Ef, are the number of FRP layer, the thickness of FRP layer (inch), the ultimate tensile strength (ksi), the ultimate tensile strain (unitless), and the modulus of elasticity (ksi), respectively. The material properties of FRP are specified by the supplier based on a rigorous laboratory test program (e.g., tensile testing of FRP coupons.) For determining the specific design of the splice system, including length, number of layers, and thickness, the designer may use a well stablished design code (e.g. ACI 440) and procedure similar to the one used for developing this table. In some cases there may be no requirement for testing an FRP system where such codes are used for their design. As an example, from Table 1, the required moment for 18×18" prestressed pile splices (e.g., as shown in FIG. 1 or FIG. 3) can be accommodated (e.g., by providing a Development of Moment greater that 100% of the moment provided by a non-spliced pile) with three layers of CFRP sheet with the thickness and modulus of elasticity equal to 0.12" and 24656 kilopounds per square inch (ksi), respectively. Also, as an example, FIG. 3 shows a section detail for 18×18" prestressed pile spliced using FRP sheets.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A fiber reinforced polymer (FRP) splice system for joining two prestressed-precast concrete structural elements, the system comprising:

a first prestressed-precast concrete structural element having a first end portion comprising prestressed-precast concrete adjacent a first end face comprising prestressed-precast concrete;

an FRP member affixed to the prestressed-precast concrete of the first end portion; and a first FRP strip encircling the FRP member and the first end portion at a first offset distance measured along the first end portion from the first end face, the FRP member covering the majority of at least one side of the first end portion, the FRP member having a first length measured along the first end portion and a second length extending beyond the first end portion, the first length and the second length each respectively being less than a length of the first prestressed-precast concrete structural element, the first length being essentially equal to or greater than the first offset distance, and the FRP member being:

a) a first FRP sheet assembled with at least a second FRP sheet to form an FRP sheet splice encircling the first end portion; or b) a first FRP construct assembled with at least a second FRP construct to form an FRP construct splice encircling the first end portion.

2. The system according to claim 1, further comprising:

a second prestressed-precast concrete structural element having a second end portion comprising prestressed-precast concrete adjacent a second end face comprising prestressed-precast concrete, the second end face being positioned opposing the first end face;

a second FRP strip encircling the FRP member and the second end portion at a second offset distance measured along the second end portion from the second end face, the second FRP strip being on an opposite side of the first end face with respect to the first FRP strip;

an alignment bar protruded from one of the first end face or the second end face;

an alignment receptacle recessed within the other of the first end face or the second end face, the alignment receptacle configured to receive the alignment bar when the first end portion is in a desired state of alignment with respect to the second end portion; and a resin bonding the FRP member to at least one of the first end portion, the second end portion, the first FRP strip, and the second FRP strip.

3. The system according to claim 1, the FRP member having a fiber orientation along a direction of the first length, and the first FRP strip having a fiber orientation along a direction encircling the FRP member and the first end portion.

4. The system according to claim 2, comprising a third FRP strip encircling the FRP member, the first end face, and the second end face;

the third FRP strip being aligned with the first end face and the second end face in an axial direction with respect to the first prestressed-precast concrete structural element.

5. The system according to claim 4, the third FRP strip having a fiber orientation along a direction encircling the FRP member, the first end face, and the second end face.

6. The system according to claim 4, the FRP member being formed of either a single layer or multiple layers, and at least one of the first FRP strip, the second FRP strip, and the third FRP strip being formed of either a single layer or multiple layers.

7. The system according to claim 1, the FRP member having a set of design parameters comprising a number of layers, a thickness, and a modulus of elasticity, and the set of design parameters configured to produce a development of moment from the FRP splice system equal to or greater than a moment of the first prestressed-precast concrete structural element.

8. The system according to claim 2, the alignment bar being a generally cylindrical protrusion, and the alignment receptacle being a drilled or cast hole.

9. The system according to claim 1, the FRP member and the first FRP strip being either formed separately and then assembled to the first end portion, or formed together as a unit prior to assembly to the first end portion.

10. The system according to claim 2, the first prestressed-precast concrete structural element and the second prestressed-precast concrete structural element each being a prismatic prestressed concrete pile.

11. A method for joining structural two prestressed-precast concrete elements with a fiber reinforced polymer (FRP) splice system, the method comprising:

providing a first prestressed-precast concrete structural element having a first end portion comprising prestressed-precast concrete adjacent a first end face comprising prestressed-precast concrete;

affixing an FRP member to the prestressed-precast concrete of the first end portion such that a first length of the FRP member runs along a portion of the first end portion and a second length of the FRP member extends beyond the first end portion, and the FRP member covers the majority of at least one side of the first end portion over the first length, the FRP member comprising a first FRP sheet or construct assembled with at least a second FRP sheet or construct, the first length and the second length each respectively being less than a length of the first prestressed-precast concrete structural element; and affixing a first FRP strip encircling the FRP member and the first end portion at a first offset distance measured along the first end portion from the first end face, the first length being essentially equal to or greater than the first offset distance, thus forming a first prestressed-precast concrete structural element.

12. The method according to claim 11, further comprising providing a first alignment feature by either: (a) creating or placing a recess on the first end face; or (b) creating or placing a protrusion on the first end face.

13. The method according to claim 12, further comprising:

providing a second prestressed-precast concrete structural element having a second end portion comprising prestressed-precast concrete adjacent a second end face comprising prestressed-precast concrete;

positioning the second end face opposing the first end face;

advancing the first end face to a position proximal the second end face to create a desired state of alignment of the first end portion with respect to the second end portion, the desired state of alignment being such that the FRP member, after being affixed, covers the majority of at least one side of the second end portion over the second length;

affixing the FRP member to the prestressed-precast concrete of the second end portion; and affixing a second FRP strip encircling the FRP member and the second end portion at a second offset distance measured along the second end portion from the second end face, the second FRP strip being on an opposite side of the first end face with respect to the first FRP strip.

14. The method according to claim 13, comprising providing a second alignment feature by either: (a) creating or placing a recess on the second end face; or (b) creating or placing a protrusion on the second end face.

15. The method according to claim 14, the step of advancing the first end face to a position proximal the second end face comprising engaging the first alignment feature with the second alignment feature to align the first end face with the second end face.

16. The method according to claim 15, the FRP member having a fiber orientation along the direction of the first length, and the first FRP strip having a fiber orientation along a direction encircling the FRP member and the first end portion.

17. The method according to claim 16, comprising affixing a third FRP strip encircling the FRP member, the first end face, and the second end face, the third FRP strip being aligned with the first end face and the second end face in an axial direction with respect to the first prestressed-precast concrete structural element, the FRP member being formed of either a single layer or multiple layers, and the first FRP strip, the second FRP strip, and the third FRP strip being formed of either a single layer or multiple layers.

18. The method according to claim 17, the step of affixing the FRP member to the prestressed-precast concrete of the first end portion occurring at a manufacturing location remote from a construction site, and the step of affixing the FRP member to the prestressed-precast concrete of the second end portion occurring at the construction site following transportation of the first pre-spliced prestressed-precast concrete structural element from the manufacturing location to the construction site.

19. A fiber reinforced polymer (FRP) splice system for joining prestressed-precast concrete structural elements, the system comprising:

a first prestressed-precast concrete structural element having a first end portion comprising prestressed-precast concrete adjacent a first end face comprising prestressed-precast concrete;

an FRP member affixed to the prestressed-precast concrete of the first end portion;

a first FRP strip encircling the FRP member and the first end portion at a first offset distance measured along the first end portion from the first end face;

a second prestressed-precast concrete structural element having a second end portion comprising prestressed-precast concrete adjacent a second end face comprising prestressed-precast concrete, the second end face being positioned opposing the first end face;

a second FRP strip encircling the FRP member and the second end portion at a second offset distance measured along the second end portion from the second end face, the second FRP strip being on an opposite side of the first end face with respect to the first FRP strip;

an alignment bar protruded from one of the first end face or the second end face;

an alignment receptacle recessed within the other of the first end face or the second end face, the alignment receptacle configured to receive the alignment bar when the first end portion is in a desired state of alignment with respect to the second end portion;

a resin bonding the FRP member to at least one of the first end portion, the second end portion, the first FRP strip, and the second FRP strip; and a third FRP strip encircling the FRP member, the first end face, and the second end face, the FRP member having a first length measured along the first end portion and a second length extending beyond the first end portion, the first length being essentially equal to or less than the first offset distance, the FRP member covering the majority of at least one side of the first end portion over the first length, and the FRP member being:

a) a first FRP sheet assembled with at least a second FRP sheet to form an FRP sheet splice encircling the end portion; or b) a first FRP construct assembled with at least a second FRP construct to form an FRP construct splice encircling the end portion.

20. The system according to claim 19, the FRP member having a fiber orientation along the direction of the first length, the first FRP strip having a fiber orientation along a direction encircling the FRP member and the first end portion, the FRP member being formed of either a single layer or multiple layers, at least one of the first FRP strip, the second FRP strip, and the third FRP strip being formed of either a single layer or multiple layers, the FRP member having a set of design parameters comprising a number of layers, a thickness, and a modulus of elasticity, the set of design parameters chosen to produce a development of moment from the FRP splice system equal to or greater than the moment of the first prestressed-precast concrete structural element, the alignment bar being a generally cylindrical protrusion, the alignment receptacle being a drilled or cast hole, at least the FRP member and the first FRP strip either being formed separately and then assembled to the first end portion, or being formed together as a unit prior to assembly to the first end portion, and the first prestressed-precast concrete structural element and the second prestressed-precast concrete structural element each being a prismatic prestressed concrete pile.

* * * * *